US006065627A

United States Patent [19]

Johanson

[11] Patent Number: 6,065,627

[45] Date of Patent: May 23, 2000

[54] BUNG FOR A PRESSURE VESSEL

[75] Inventor: James E. Johanson, Chatham, N.Y.

[73] Assignee: Sonoco Development, Inc., Hartville, S.C.

[21] Appl. No.: 09/236,698

[22] Filed: Jan. 25, 1999

Related U.S. Application Data

[63] Continuation of application No. 08/722,815, Sep. 27, 1996, Pat. No. 5,862,936.

[51] Int. Cl.[7] ..... B65D 53/00

[52] U.S. Cl. ..... 220/304; 220/284; 220/601; 220/661

[58] Field of Search ..... 220/304, 601, 220/661, 284, 288, 378; 215/354, 356

[56] References Cited

U.S. PATENT DOCUMENTS

| | | |
|---|---|---|
| 689,896 | 12/1901 | Manierre . |
| 1,080,659 | 12/1913 | Schuh . |
| 1,324,896 | 12/1919 | Hettinger . |
| 1,629,303 | 5/1927 | Phillips . |
| 1,640,508 | 8/1927 | Lobl . |
| 1,734,232 | 11/1929 | Ryan et al. . |
| 1,915,310 | 6/1933 | Grosser . |
| 1,929,794 | 10/1933 | Rosselle . |
| 1,952,036 | 3/1934 | Dillhoefer, Jr. . |
| 2,008,245 | 7/1935 | Curtis et al. . |
| 2,025,852 | 12/1935 | Dillhoefer, Jr. . |
| 2,028,175 | 1/1936 | Waite . |
| 2,138,060 | 11/1938 | Conner . |
| 2,156,237 | 4/1939 | Draper . |
| 2,172,644 | 9/1939 | Smith . |
| 2,291,706 | 8/1942 | Frease . |
| 2,312,738 | 3/1943 | Ulanet . |
| 2,339,255 | 1/1944 | Dodson . |
| 2,445,802 | 7/1948 | Robinson . |
| 2,769,566 | 11/1956 | Thompson . |
| 2,770,260 | 11/1956 | Henderson . |
| 2,829,794 | 4/1958 | Epps . |
| 2,848,130 | 8/1958 | Jesnig . |
| 2,906,429 | 9/1959 | Marchyn . |
| 3,027,042 | 3/1962 | Graves . |
| 3,039,641 | 6/1962 | Rosan . |
| 3,122,262 | 2/1964 | Hagmann et al. . |
| 3,173,569 | 3/1965 | Craig . |
| 3,334,772 | 8/1967 | Henderson . |
| 3,346,278 | 10/1967 | Yocum . |
| 3,380,618 | 4/1968 | Phillips . |
| 3,405,837 | 10/1968 | Carpenter, Jr. . |
| 3,468,450 | 9/1969 | Webel . |
| 3,487,442 | 12/1969 | Rossmann . |
| 3,589,550 | 6/1971 | Rossmann . |
| 3,664,540 | 5/1972 | Witkin . |
| 3,785,539 | 1/1974 | Wetterek . |
| 3,891,118 | 6/1975 | Laurizio . |
| 4,005,799 | 2/1977 | Mannaerts . |
| 4,078,696 | 3/1978 | Crisci . |
| 4,146,207 | 3/1979 | Rofe . |
| 4,164,304 | 8/1979 | Roberson . |
| 4,190,171 | 2/1980 | Kulle et al. . |
| 4,195,750 | 4/1980 | Fee . |
| 4,201,306 | 5/1980 | Dubois et al. . |

(List continued on next page.)

FOREIGN PATENT DOCUMENTS

| | | |
|---|---|---|
| 94308375 | 5/1995 | European Pat. Off. . |
| 352256 | 3/1961 | Switzerland . |
| 1004847A | 4/1979 | United Kingdom . |
| 2227736A | 8/1990 | United Kingdom . |

*Primary Examiner*—Stephen K. Cronin
*Attorney, Agent, or Firm*—Seidal, Gonda, Lavorgna & Monaco, PC

[57] ABSTRACT

A bung is provided for sealing an opening in a pressure vessel. The bung includes an annular body portion and a flange extending radially outwardly for one end of the body. In one embodiment the flange includes an inner inclined surface adjacent the annular body portion. In an alternate embodiment, the vessel includes an inclined or angled engagement surface adjacent the vessel opening. A gasket is provided between the flange of the bung and the engagement surface adjacent the vessel opening. The inclined surface of the bung and/or the vessel urges the gasket radially inwardly upon the bung being threaded into the pressure vessel opening.

5 Claims, 5 Drawing Sheets

U.S. PATENT DOCUMENTS

| | | |
|---|---|---|
| 4,245,306 | 1/1981 | Ellis . |
| 4,494,673 | 1/1985 | Hiraishi . |
| 4,589,564 | 5/1986 | Olster et al. . |
| 4,711,365 | 12/1987 | Fomby . |
| 5,109,997 | 5/1992 | Phillips . |
| 5,207,345 | 5/1993 | Stewart et al. . |
| 5,211,304 | 5/1993 | Stolzman . |
| 5,305,906 | 4/1994 | Dietrich et al. . |
| 5,356,030 | 10/1994 | Budenbender . |
| 5,379,913 | 1/1995 | Rieke et al. . |
| 5,458,257 | 10/1995 | Muckelrath et al. . |
| 5,680,953 | 10/1997 | Baughman . |

BUNG FOR A PRESSURE VESSEL

This is a continuation of copending application Ser. No. 08/722,815 filed on Sep. 27, 1996 which issued as U.S. Pat. No. 5,862,936 on Jan. 26, 1999.

FIELD OF THE INVENTION

The present invention relates generally to a bung or cap for sealing an opening in a drum or vessel, and more particularly to a bung having a body and a flange adapted to urge a sealing gasket in both a radially inward direction and an axial direction to form a high pressure seal.

BACKGROUND OF THE INVENTION

Vessels or drums are often used to store and dispense substances such as gas or liquid. An opening is provided in the vessel to allow these substances to be filled into and dispensed from the vessel. The vessel is sealed at its opening with a removable bung or cap to prevent its contents from escaping from the opening.

The vessels are sometimes pressurized to facilitate the dispensing of stored liquids or gases or as the result of thermal expansion. However, the pressure increases the risk of leakage from the vessel opening. The leakage may be caused by the flexing and/or distortion of the vessel structure caused by the internal pressure, as well as by temperature changes and shipment activity. This problem is particularly troublesome when the vessel or the bung are made with plastic materials.

In the past, attempts have been made to design a pressure vessel and bung to provide an adequate seal. Sealing materials or gaskets have been used with bungs to improve the leak resistance of the seal between the bung and the vessel opening. An axial compression force is applied to the gasket by the bung, urging it against the wall of the vessel adjacent the opening.

However, the pressurized liquid or gas in the vessel exerts radial outward forces on the gasket material. These outward forces may result in the forcing of the gasket radially outwardly and create a leak or a total rupture of the gasket.

SUMMARY OF THE INVENTION

The present invention relates to a bung for engaging and sealing an opening in a vessel. The bung includes an annular body portion and a flange which extends radially outwardly from one end of the annular portion. The annular portion includes external threads thereon for engaging corresponding threads in the opening of the vessel. The flange has an inclined surface on its underside which forms an angle with respect to the axis of the annular body portion. The inclined surface is positioned adjacent the annular body portion and is directed radially inward. A sealing gasket is disposed about the body and is maintained within the gap formed by the annular portion and the inclined surface. As the threads move the bung further into the vessel opening, the flange urges the sealing member axially against the vessel. In addition, the angle of the inclined surface urges the gasket radially inward against the annular body of the bung. The inclined surface thereby forms a seal between the body of the bung and the gasket. The inclined surface and its corresponding inward radial force on the gasket creates a positive resistance to the expansion of the gasket radially outwardly due to the pressure within the vessel.

As an alternative, the inclined surface may be provided as part of the lip on the vessel adjacent the opening for receipt of the bung. The inclined surface creates a radially inward force on the gasket and a positive resistance to the expansion of the gasket due to pressure within the vessel. This structure on the vessel may be used in conjunction with various gasket crosssectional shapes and with a bung having a standard construction or having an inclined surface in accordance with the present invention.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
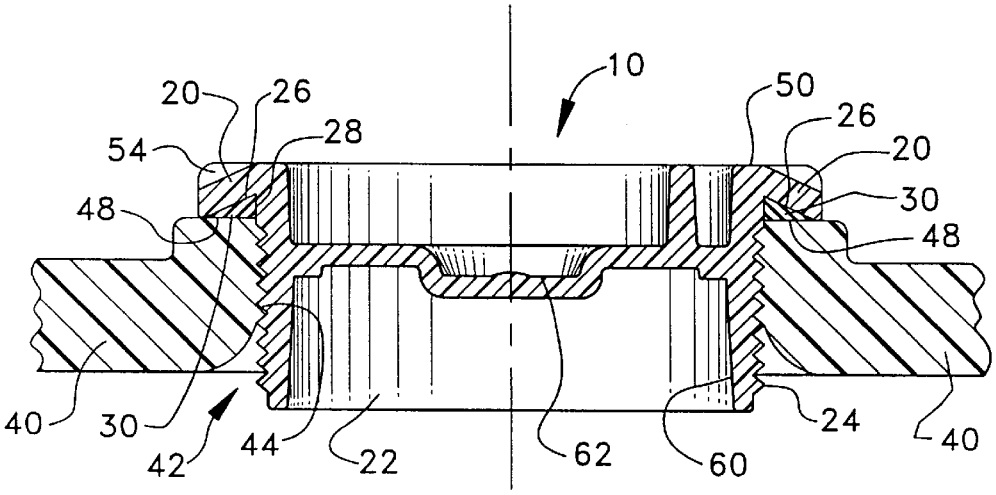
FIG. 1 is a sectional view of a bung within the opening of a vessel as contemplated by the present invention.

In the drawings, where like numerals identify like elements, there is shown in FIG. 1 a bung or cap for a pressure vessel or the like. The bung is generally referred to by the numeral 10. The bung 10 has a flange 20 extending radially outwardly from one end of an annular body portion 22. The annular body 22 has an thread on its outside surface 24. A sealing surface 28 is provided adjacent the flange 20, above the threaded surface 24. The flange 20 has an inwardly directed inclined surface 26 on its underside. The inclined surface forms an acute angle with the axis of the annular body portion 22. The inclined surface 26 and the sealing surface 28 define an open gap on the underside of the flange 20. Although the inclined surface 26 is shown to be substantially planer in FIG. 1, it is contemplated that this surface may also be convex or concave curvilinear, if desired.

As shown in FIG. 1, the bung 10 engages the pressure vessel 40 within an opening 42 therein. The opening 42 has an internally threaded portion 44. A sealing surface 48 is provided adjacent the opening 42. The bung 10 is threaded into the pressure vessel opening 42. A seal is formed between the bung 10 and the pressure vessel 40 in the area of a sealing member or gasket 30. The gasket 30 is disposed about the annular body portion 22 of the bung 10. As the bung 10 is threaded into the opening 42, the inclined surface 26 is maintained in contact with the upper surface of the gasket 30. The gasket 30 is then axially compressed between the sealing surfaces 48 on the vessel 40 and the inclined surface 26.

The downward movement of the bung 10 also creates a radially inward force on the gasket 30. The inclined surface 26 on the underside of the flange 20 is at a sufficient angle to urge the gasket material inwardly against the adjacent sealing surface 28 on the cylindrical body portion 22 of the bung 10. This radially inward force further seals the opening 42 in the vessel 40.

In a preferred embodiment, the threaded portions 24, 44 of the bung 10 and the pressure vessel 40 have a standard two inch NPS thread. However, it is understood that almost any thread pattern and size may be utilized.

Figure 2:
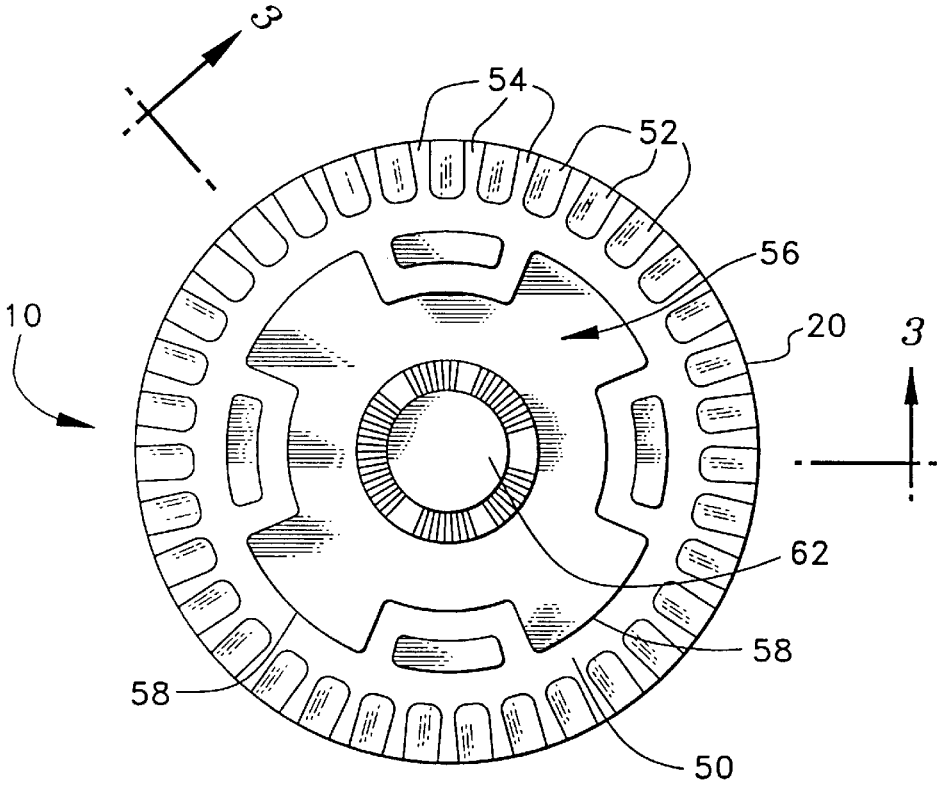
FIG. 2 is a top view of the bung of the present invention.

FIG. 2 shows the top of the bung 10. The top wall or surface 50 of the bung 10 has a recess 56 therein, which forms a plurality of wrench engagement slots 58. The flange 20 also includes an upper edge surface 52 having a plurality of nubs 54 projecting upwardly therefrom. The nubs 54 increase the friction for engaging the bung 10 during opening or tightening.

Figure 3:
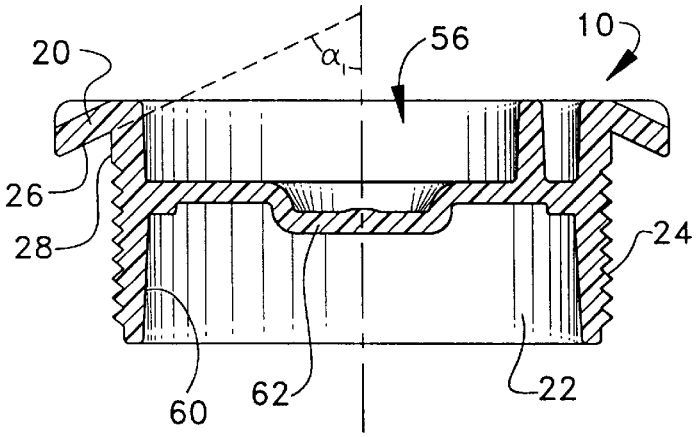
FIG. 3 is a partial sectional view of the bung of the present invention taken along line 3—3 in FIG. 2.

FIG. 3 shows the bung 10 separate from the vessel opening. The recess 56 within the top wall 50 of the bung 10 includes a central depression 62. A series of threads or the like (not shown) may be formed within the depression 62 for the purpose of attaching additional structures. The cylindrical body portion 22 has a lower cylindrical sleeve 60 with the external threads 24 formed on the outside surfaces thereof. As illustrated, the flange 20 extends radially outward from the upper portion of the cylindrical body 22. The inclined surface 26 of flange 20 forms an angle $\alpha_1$ with the axis and the body 22.

Figure 4:
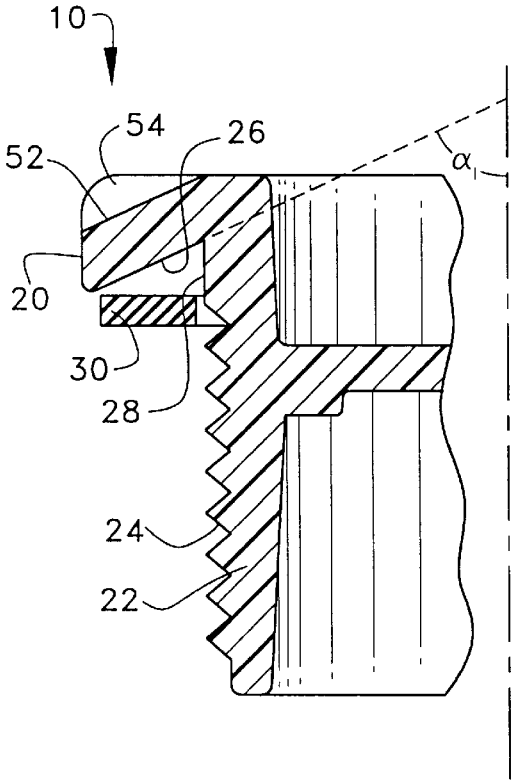
FIG. 4 is an enlarged, partial sectional view of the bung shown in FIGS. 1–3.

Referring to FIG. 4, the gasket 30 is shown disposed about the body 22. The gasket 30 is formed in an annulus and has a generally rectangular cross section. The gasket 30 is preferably made from an elastomeric material. The inside diameter of the gasket 30 is preferably slightly larger than the outside diameter of the sealing surface portion of the cylindrical body 22 of the bung 10. In addition, the gasket 30 has sufficient thickness and/or height so that the upper surface is brought into engagement with the inclined surface 26 of the flange 20. In addition, angle a, is steep enough to force the gasket material radially inward toward the bung sealing surface 28 during tightening of the bung 10 in the vessel opening 42 by means of the engaging threads 24, 44 (FIG. 1). It is the combination of the gasket 30 and the inclined surface 26 of the flange 20 that creates the additional inward compression of the gasket 30 against the sealing surface 28 on the cylindrical body 22.

Figure 5:
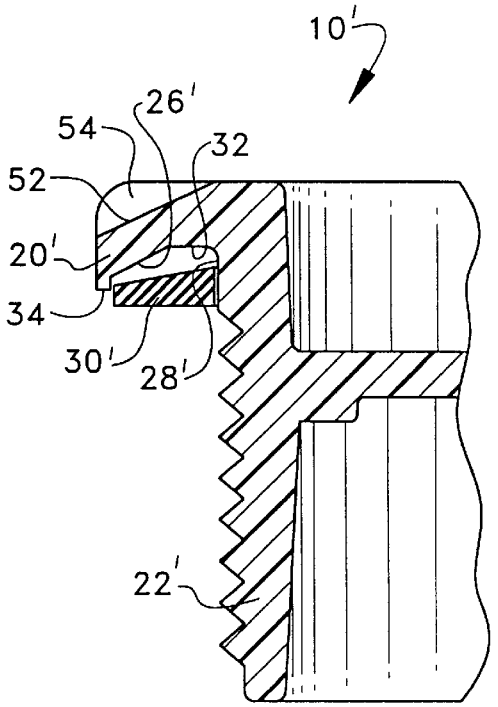
FIG. 5 is an enlarged, partial sectional view of an alternative bung and sealing member embodiment.

In FIG. 5, there is shown an alternative embodiment of the bung 10' and gasket 30'. The inclined surface 26' on the flange 20' is spaced from the sealing surface 28' on the cylindrical body portion 22' by means of radial surface 32. Also, the flange 20' includes a retaining ring or wall 34 at the lower or outermost edge of the inclined surface 26'. The retaining ring 34 is positioned radially outwardly of the outer diameter of the gasket 30'. The gasket 30' has an angled top surface and forms a wedge shape in cross-section. The wedge shaped gasket 30' assists the inclined surface 26' in creating the radially inward force of the gasket 30' toward the sealing surface 28' of the bung 10'. Also, additional sealing surface area is provided by the radial surface 32. As the inclined surface 26' on the flange 20' of the bung 10' compresses the gasket 30', the radially inward portion of the upper surface of the gasket 30' expands into contact with the radial surface 32. This additional seal area is created by the expansion of the gasket within the gap formed by the radial surface 32, inclined surface 26', sealing surface 28' and retaining wall 34 creates an additional sealing force to the radially inward force created by the inclined surface 26.

Figure 6:
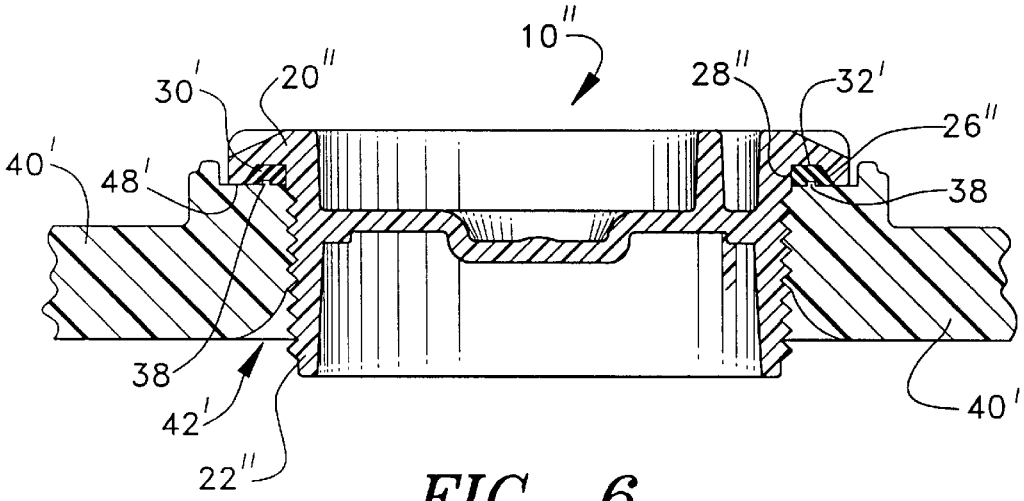
FIG. 6 is a sectional view of a further alternative embodiment of a bung and vessel as contemplated by the present invention.

Referring to FIG. 6, there is shown another alternate embodiment of a bung 10". The flange 20" in this embodiment has an inclined surface 26" and a radial surface 32' similar to that shown in FIG. 5. In this embodiment, there is no separate retaining wall or ring projecting below the lower end of the inclined surface 26". The gasket 30' is disposed about the cylindrical body 22" as in the other embodiments discussed above. The inclined surface 26" maintains the radially inward force on the gasket 30'. The sealing surface 48' on the vessel 40' includes an annular ring or nub 38 that projects upwardly. The nub 38 projects into the lower surface of gasket 30' when the bung 10" is tightened into the opening 42' of the vessel 40'. The nub 38 creates an additional obstruction to the passage of the pressurized gas or fluid from within the vessel 40' and along the intersection between the gasket 30' and the sealing surface 48'. Thus, the projection of the nub 38 into the gasket 30' further assists in creating a seal for the vessel 40'.

Figure 7:
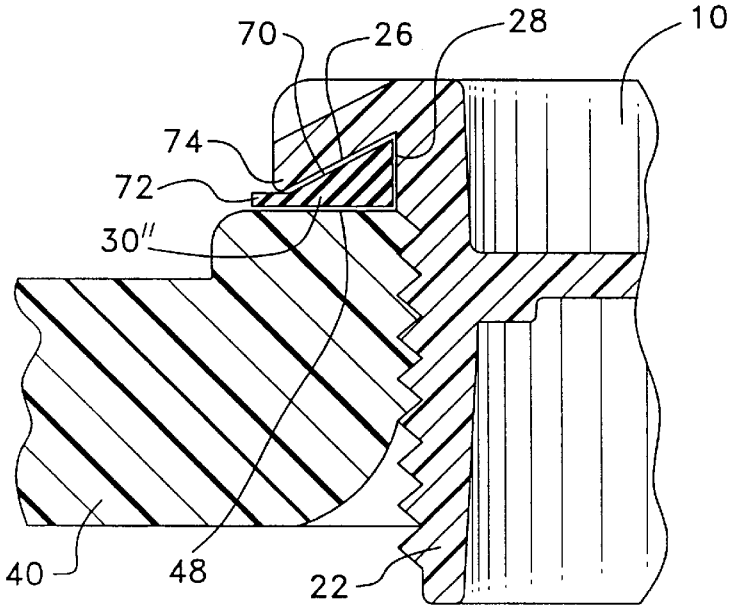
FIG. 7 is an enlarged, partial sectional view of a still further bung and sealing member embodiment.

In FIG. 7, there is shown a further alternate embodiment of a gasket 30" for use with the bung 10 of the type shown in FIG. 1. The gasket 30" is formed in an annulus having at least one portion that is wedge shaped in cross-section. An inclined top surface 70 is provided on the gasket 30" and positioned adjacent the inclined surface 26 on the flange 20 of the bung 10. Although the slope of the incline on the flange surface 26 is shown to be parallel to the upper surface 70 of the wedge shaped portion of the gasket 30", it is contemplated that relative differences in these angles may be advantageous and may be utilized as desired. Radially outward of the wedge shaped portion of the gasket 30" is an edge ring 72. The edge ring 72 is integrally formed with the wedge shaped portion and projects from the base of the wedge. The edge ring 72 is positioned under the peripheral edge 74 of flange 20 at the base of the inclined surface 26. As illustrated, the edge ring 72 projects radially beyond the edge 74 of the flange 20 along the sealing surface 48 of the vessel 40. The engagement of the edge 74 of flange 20 with the edge ring 72 of the gasket 30" creates further sealing of the vessel opening 42.

The relative angle of the inclined surface of the flange of the bung and size and shape of the gasket create the radial inward force on the gasket, pushing it into contact with the inner sealing surface of the bung. The inside diameter of the gasket is approximately the same diameter as that of the sealing surface on the cylindrical portion of the bung. Preferably the inside diameter of the gasket is slightly larger than the diameter of the sealing surface for purposes of ease of assembly. The size of the gasket determines the engagement with the inclined surface of the bung flange and the amount of compression of same. This compression of the gasket in combination with the angle $\alpha_1$, of the inclined flange surface is what creates the radially inward force which also compresses the gasket against the sealing wall of the cylindrical portion of the bung.

It should be apparent that the features of the invention may be accomplished with a number of gasket forms. For example, a typical O-ring type gasket may also be utilized. Other cross-sectional configurations may also be utilized without departing from the desired features of the invention.

Figure 8:
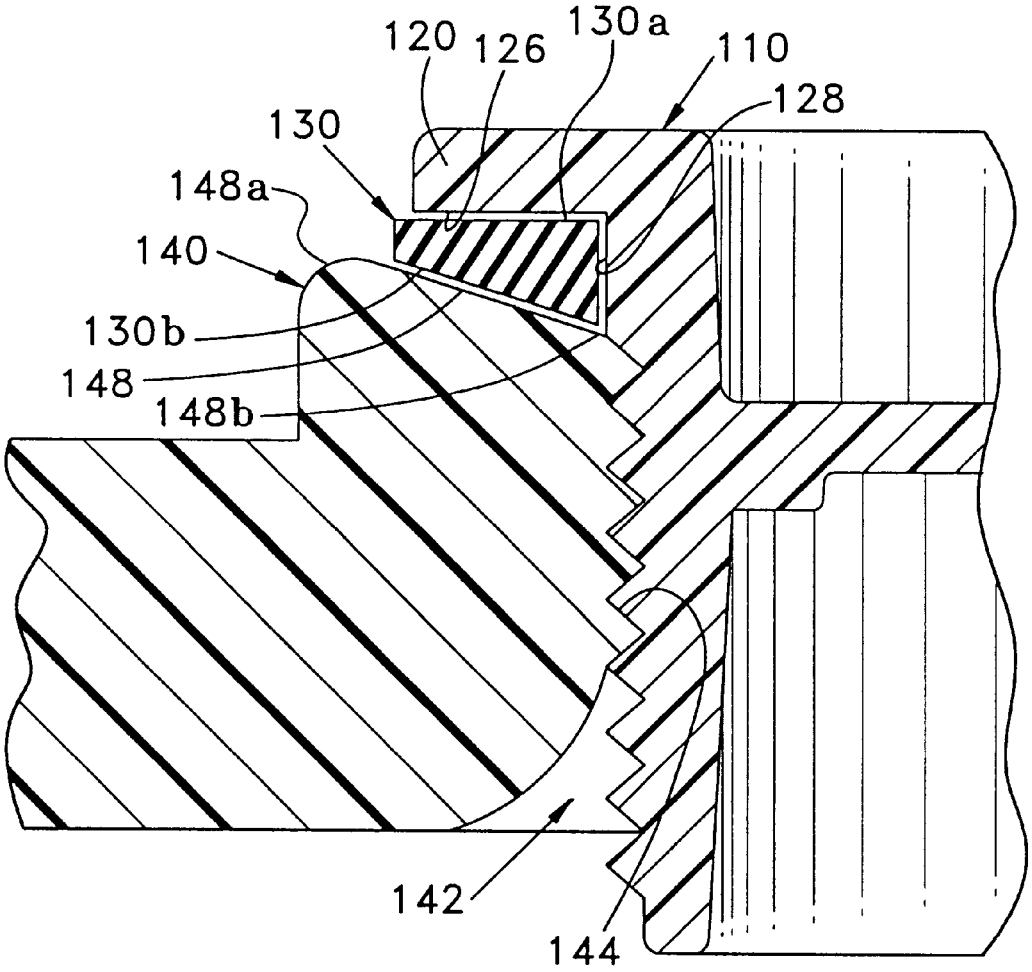
FIG. 8 is an enlarged, partial sectional view of a further embodiment of the present invention.

In FIG. 8, there is shown a variation of the present invention. In this embodiment, the bung 110 includes a flange 120 having an engagement surface 126 which is formed generally perpendicular to the cylindrical sealing surface 128. Thus, the bung 110 is generally in the form of a standard bung or cap. The bung 110 is engaged within an opening 142 within the pressure vessel 40. As in the other embodiments, the opening 142 is provided with internal threads 144. The sealing surface 148 adjacent the opening 142 is inclined or sloped inwardly, such that the outer edge thereof 148*a* is axially above the inner edge 148*b*. A gasket 130 is provided axially above the sealing surface 148 and below the flange engagement surface 126 on bung 110. As illustrated in FIG. 8, the gasket 130 has one radially extending surface 130*a* and a tapered or angled surface 130*b* on opposite sides thereof. The angled surface 130*b* on the gasket 130 is positioned adjacent the inclined sealing surface 148 of the vessel 140. The engagement surface 126 of the bung flange 120 engages the radial surface 130*a* of the gasket as the bung 110 is threaded into the opening 142 in the vessel 140. The angle of the sealing surface 148 on the vessel 140 creates a radially inward force on the gasket 130, causing it to engage the sealing surface 128 on the bung 110, as the gasket 130 is compressed axially.

Figure 9:
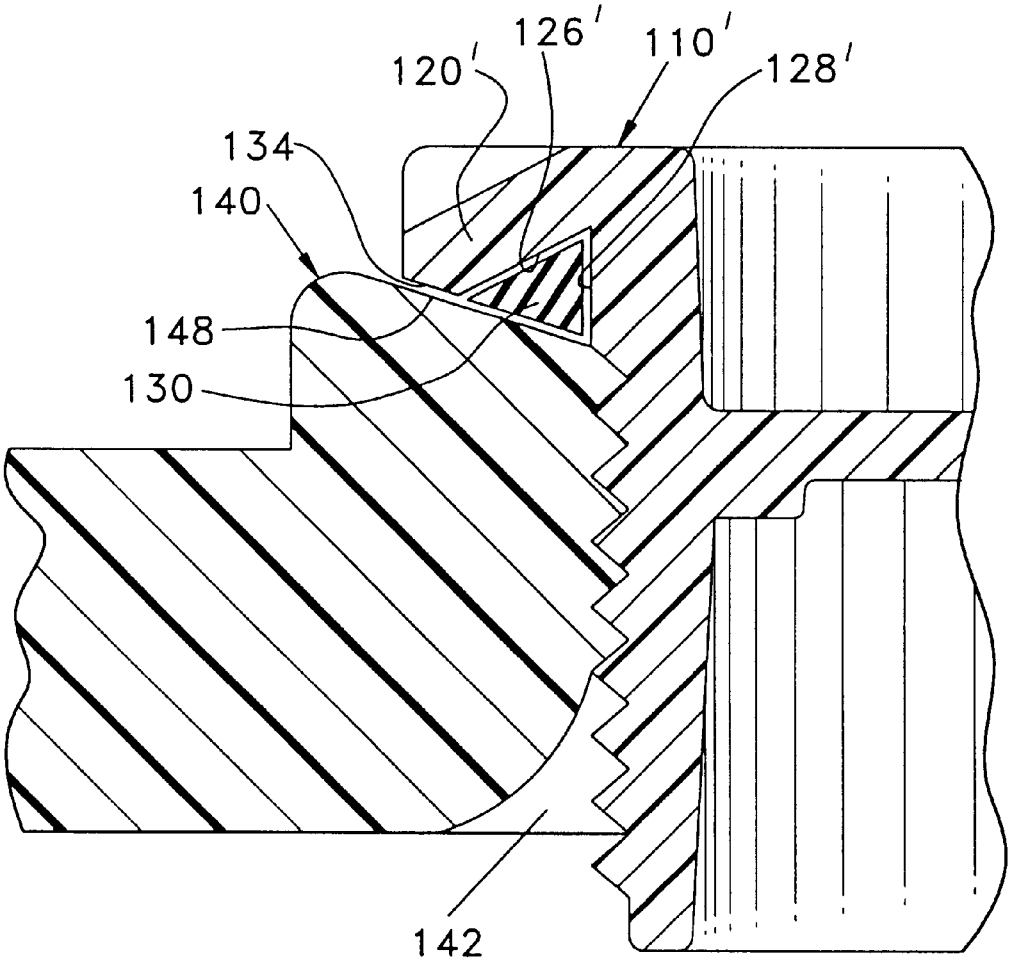
FIG. 9 is an enlarged, partial sectional view of a still further embodiment of the invention.

In FIG. 9, there is shown a vessel 140 similar to that shown in FIG. 8. The bung 110' is provided with a flange 120' having an angled or inclined surface 126', similar to that provided on bungs 10, 10' and 10" (discussed above). The inclined surface 126' of flange 120' and the angled surface 148 of the vessel 140 converge radially outwardly from the axial engagement or sealing surface 128' of the bung 110'. A triangular shaped gasket 130' is provided between the flange 120', the sealing surface 128' and the vessel engagement surface 148. A relief surface 134 is provided on the radial peripheral edge of the flange 120' to permit complete compression of the gasket 130'. Again, threading of the bung 110' into the opening in the vessel 140 causes axial compression of the gasket 130' and a radially inward force against the engagement surface 126' of the bung 110'.

It is difficult to define a precise range of gasket sizes and angles for the inclined surface. It is contemplated that the angle $\alpha_1$ of the incline will be steep enough to force the gasket material radially inward toward the bung sealing surface during tightening of the bung into the vessel opening. It is not sufficient for the mere compression of the gasket to fill the void between the flange and the sealing surface adjacent the opening if the vessel. Again, it is the combination of the gasket and the angle of the inclined surface of the flange and/or the vessel that creates the additional inward sealing force by the gasket against the sealing surface on the cylindrical body of the bung.

The present invention may be embodied in other specific forms without departing from the spirit or essential attributes thereof and, accordingly, reference should be made to the appended claims, rather than to the foregoing specification, as indicating the scope of the invention.

What is claimed is:

1. A bung for a pressure vessel, the pressure vessel having an internally threaded opening for receiving the bung assembly, the bung assembly comprising:

an externally threaded cylindrical body portion, an outwardly radiating flange integrally formed with and disposed at one end of said body portion, said flange having an inclined inner sidewall forming an acute angle with said body portion, and an annular ring-shaped gasket disposed about said cylindrical body portion, said gasket having a substantially wedge shaped cross-section with a first surface in communication with the sidewall of the cylindrical body, a second surface in communication with the inclined surface of said flange, and a third surface in communication with said pressure vessel, said inclined sidewall engaging the second surface of the gasket and biasing said first gasket surface radially inwardly against said body portion in addition to the biasing of the third gasket surface against said pressure vessel to form a pressure seal between the bung and the pressure vessel.

2. The bung assembly according to claim 1, wherein the gasket is made from an elastomeric material.

3. A closure assembly for a pressure vessel having an internally threaded opening comprising:

a bung comprising a body having an annular portion including an external thread thereon, a flange extending radially outward from an end of the annular portion, said flange having an outer inclined surface positioned radially outward of the annular portion forming an angle with respect to said annular portion;

a gasket comprising a substantially wedge shaped cross-section, disposed about the body adjacent the flange and having a radial dimension such that the inclined surface engages and urges the gasket radially inward against the annular portion of the body upon the bung being axially threaded into the pressure vessel opening so as to form a seal between the bung and the pressure vessel.

4. A closure assembly for a pressure vessel as claimed in claim 3, further comprising a flat surface spacing the inclined surface from the annular portion of the body.

5. A closure assembly for a pressure vessel having an internally threaded opening comprising:

a bung comprising a body having an annular portion including an external thread thereon, a flange extending radially outward from an end of the annular portion, said flange having an intermediate surface that extends from and forms a substantially right angle with the annular portion and an outer surface that extends from and forms an angle with the intermediate surface of between 90° and 180° thereby forming a space between the outer surface and the annular portion;

a gasket, substantially wedge shaped in cross-section, disposed about the body adjacent the flange, the gasket being shaped to substantially fill the space between the bung outer surface and the annular portion such that the bung outer surface engages and urges the gasket radially inward against the annular portion of the body upon the bung being axially threaded into the pressure vessel opening so as to form a seal between the bung and the pressure vessel.

* * * * *